US006910362B2

(12) United States Patent
Childs et al.

(10) Patent No.: US 6,910,362 B2
(45) Date of Patent: Jun. 28, 2005

(54) TILT MECHANISM FOR A TRANSFER RAIL IN A PRESS TRANSFER SYSTEM

(75) Inventors: Montgomery W. Childs, Barrie (CA); Ronald A. Laing, Barrie (CA)

(73) Assignee: Linear Transfer Systems, Ltd., Ontario (CA)

( * ) Notice: Subject to any disclaimer, the term of this patent is extended or adjusted under 35 U.S.C. 154(b) by 1 day.

(21) Appl. No.: 10/455,517

(22) Filed: Jun. 5, 2003

(65) Prior Publication Data

US 2004/0182128 A1 Sep. 23, 2004

(30) Foreign Application Priority Data

Mar. 21, 2003 (CA) ..... 2423098

(51) Int. Cl.[7] ..... B21D 43/05

(52) U.S. Cl. ..... 72/405.16; 72/405.13; 198/621.1

(58) Field of Search ..... 72/405.16, 405.13, 72/405.1, 405.09, 405.08, 405.01; 198/621.1

(56) References Cited

U.S. PATENT DOCUMENTS 3,782,561 A * 1/1974 Orii ..... 198/621.1
3,805,582 A * 4/1974 Logan ..... 72/420
4,089,203 A * 5/1978 Wallis ..... 72/405.15
4,540,087 A * 9/1985 Mizumoto ..... 198/621.1
4,680,954 A * 7/1987 Mueller et al. ..... 72/405.08
5,248,288 A * 9/1993 Kamiya et al. ..... 483/28
5,267,463 A * 12/1993 Doyama ..... 72/405.16
6,185,979 B1 * 2/2001 Schollhammer ..... 72/405.16

* cited by examiner

*Primary Examiner*—Daniel C. Crane
(74) *Attorney, Agent, or Firm*—Rader, Fishman & Grauer PLLC

(57) ABSTRACT

A tilt mechanism for a transfer rail that is used to support a plurality of grippers for engaging and moving workpieces between a series of spaced apart work stations in a linear transfer press. The transfer rail forms part of a press transfer system of the type having a drive mechanism to impart three dimensional movement to the transfer rail. The tilt mechanism comprises at least one connector and at least one actuator. The connector secures the transfer rail to the drive mechanism and permits three dimensional movement of the transfer rail. The connector also permits the transfer rail to be rotated, relative to the drive mechanism, about its longitudinal axis. The actuator is connected to both the drive mechanism and the transfer rail and causes the transfer rail to be rotated between a position where it supports the grippers in an orientation where they generally extend toward the work stations to a position where it supports the grippers in a plane that is generally perpendicular to the direction of movement of said workpieces between said work stations.

15 Claims, 7 Drawing Sheets

TILT MECHANISM FOR A TRANSFER RAIL IN A PRESS TRANSFER SYSTEM

FIELD OF THE INVENTION

This invention relates to a tilt mechanism that may be used on a transfer rail in a press transfer system.

BACKGROUND OF THE INVENTION

The manufacturing industry, and in particular the metal fabrication and stamping industries, commonly utilize automated systems that allow a workpiece to be conveyed or transferred between equally spaced workstations where particular operations are carried out. For example, many metal parts on automobiles and appliances are formed by means of a stamping procedure wherein a series of dies, that are situated on a number of aligned and equally spaced workstations within the bed of a transfer press, progressively form a workpiece upon each stroke of the press. Automated transfer systems are typically employed to grasp the workpiece, remove it from one set of dies and then transport the workpiece laterally through the press bed to the next adjacent workstation where it will be stamped a second time with a further set of dies upon the next stroke of the press.

A press transfer system utilized in conjunction with a typical multi-stage linear transfer press commonly includes at least one transversely oriented transfer rail situated adjacent to the press bed and aligned with the various workstations. Depending upon the particular application and the press layout, a single transfer rail may be positioned along one side of the press bed or, alternatively, a separate transfer rail may be located on each side of the bed of the press. Regardless, the primary function of the transfer rail is to provide a mechanism by which tools, generally referred to as grippers or fingers, may be supported adjacent to the workstations and are moved to allow a workpiece to be grasped and transported to the next workstation. Such grippers or fingers are often mounted either to the transfer rail or to a secondary tooling rail that is in some manner secured or attached to the transfer rail.

Movement of workpieces from workstation to workstation involves the movement of the transfer rail in what usually amounts to a relatively complex three dimensional manner. Described generally, this movement involves (i) moving the rail toward the workstation such that the grippers or fingers may grasp the workpiece (referred to as movement in the Y axis direction); (ii) lifting the rail upwardly to remove the workpiece from the dies of a particular workstation (referred to as movement in the Z axis direction); (iii) moving the rail laterally and parallel to the press bed to align the workpieces with the next adjacent workstation (referred to as movement in the X axis direction); (iv) lowering the rail to allow the grippers to place the workpieces onto the next adjacent set of dies (Z axis movement); (v) retracting the rail from the workstation (Y axis movement) to extract the grippers from the press bed so they are not damaged with the next stroke of the press; and, finally returning back to the starting position (X axis movement).

The primary reason for utilizing a press transfer system in fabrication and stamping operations is to maximize production efficiency through increasing the throughput of a production line. A press and its related equipment in a stamping or fabrication facility represents a significant capital investment for a manufacturer. In order to maximize the return on that investment there is a desire to maintain presses in continuous operation and to maximize the number of workpieces moving through the press over a given length of time. As a result others have devoted a considerable amount of effort into the design of transfer rails and the mechanical, electro-mechanical, hydraulic, and/or pneumatic systems that drive transfer rails in the complex three-dimensional manner described above. Still others have devoted much effort and expense in attempts to develop transfer rails that are light, rigid and sufficiently strong to facilitate rapid acceleration and deceleration as a means to increase press throughput.

While efforts in these regards have resulted in a marked improvement in the productivity when a press is in operation, little attention has been devoted to decreasing the down-time of a press when it becomes necessary to repair or replace the dies in the press bed, in circumstances where the press must be shut down for maintenance reasons, or where the fingers or grippers need to be changed or serviced. When access to the press bed is required for any of these reasons it has traditionally been necessary for the grippers or tools to be removed from the transfer rail (if a tool rail is used to hold the grippers the tool rail must be uncoupled from the transfer rail). At that point the transfer system may be moved to a "parked" position in which case the transfer rail would be moved horizontally outward from the press bed and lifted upwardly to allow unfettered and open access to the bed area of the press. Once the necessary work within the bed area has been completed the transfer system must be returned to is operational position and the grippers (or the tool rail) must be reinstalled before stamping operations can once again commence. It will be appreciated that such an operation can not only be time consuming, but can also require the services of a number of operators, adding significantly to the associated costs.

SUMMARY OF THE INVENTION

The invention therefore provides a mechanism for use in association with a transfer rail in a press transfer that presents the ability for the fingers or grippers to be moved from their operating configuration where they are adjacent to the press bed, ready to grasp workpieces, to a standby configuration that permits faster and more open access to the press bed for performing maintenance, for changing out dies, and to change or service the fingers or grippers.

Accordingly, in one of its aspects the invention provides a tilt mechanism for a transfer rail that is used to support a plurality of grippers for engaging and moving workpieces between a series of spaced apart work stations in a linear transfer press, the transfer rail forming part of a press transfer system of the type having a drive mechanism to impart three dimensional movement to the transfer rail, the tilt mechanism comprising at least one connector securing said transfer rail to said drive mechanism and permitting said drive mechanism to impart three dimensional movement to said transfer rail, said connector further permitting said transfer rail to be rotated, relative to said drive mechanism, about its longitudinal axis, and, at least one actuator operatively connected to said drive mechanism and to said transfer rail, said actuator operable between an engaged and a disengaged position, when in said disengaged position said actuator causing said transfer rail to support said grippers in an orientation with said grippers generally extending toward said work stations, when moving from said disengaged to said engaged position said actuator causing said transfer rail to rotate about its longitudinal axis and causing said transfer rail to support said grippers in a plane that is generally perpendicular to the direction of movement of said workpieces between said work stations to facilitate access to said grippers and said work stations.

In a further aspect the invention provides a tilt mechanism for a rail in a press transfer system that is used to support one or more grippers for engaging and moving workpieces between a series of spaced apart work stations in a linear transfer press, the tilt mechanism comprising one or more connectors securing said rail to said press transfer system and permitting said press transfer system to impart three dimensional movement to said rail and said one or more grippers supported thereon, said connector also permitting said rail to be rotated, relative to said press transfer system, about its longitudinal axis, and, one or-more actuators connected to said press transfer system and to said rail, said actuators operable between an engaged and a disengaged position such that movement of said one or more actuators between said engaged and said disengaged position causes rotation of said rail, relative to said press transfer system, about its longitudinal axis.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
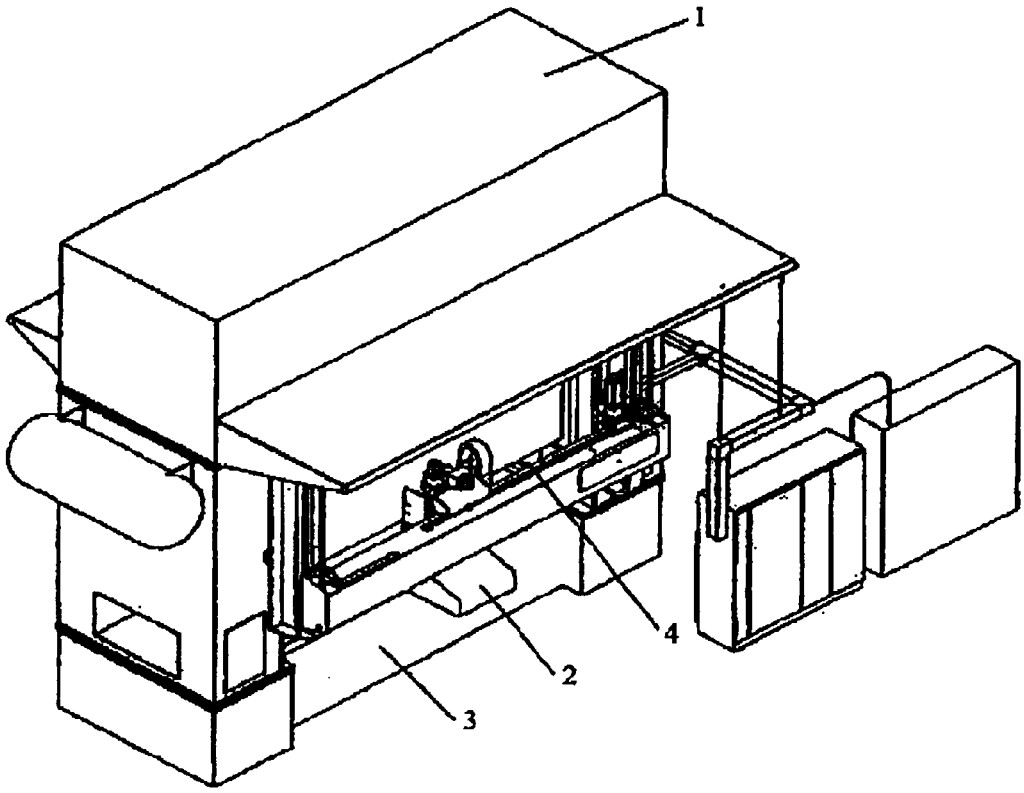
FIG. 1 is an upper side perspective view showing the general components of a linear transfer press having attached thereto a press transfer system.
Figure 3:
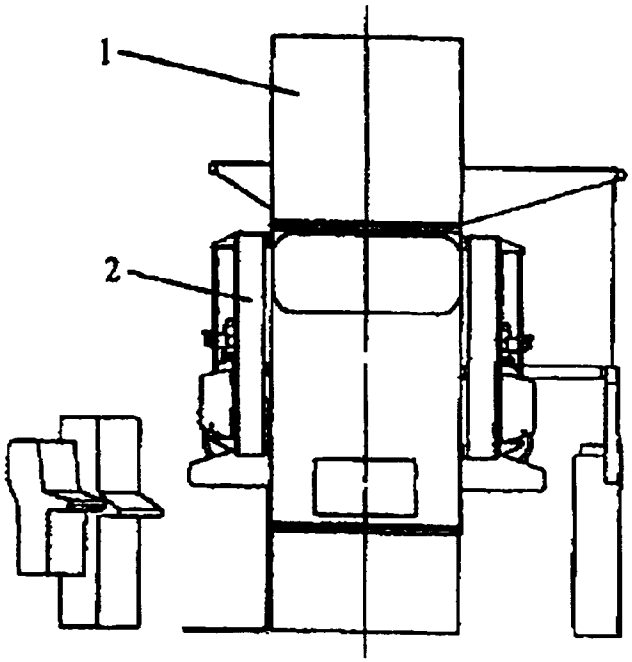
FIG. 3 is an end elevational view of the transfer press shown in FIG. 1.
Figure 2:
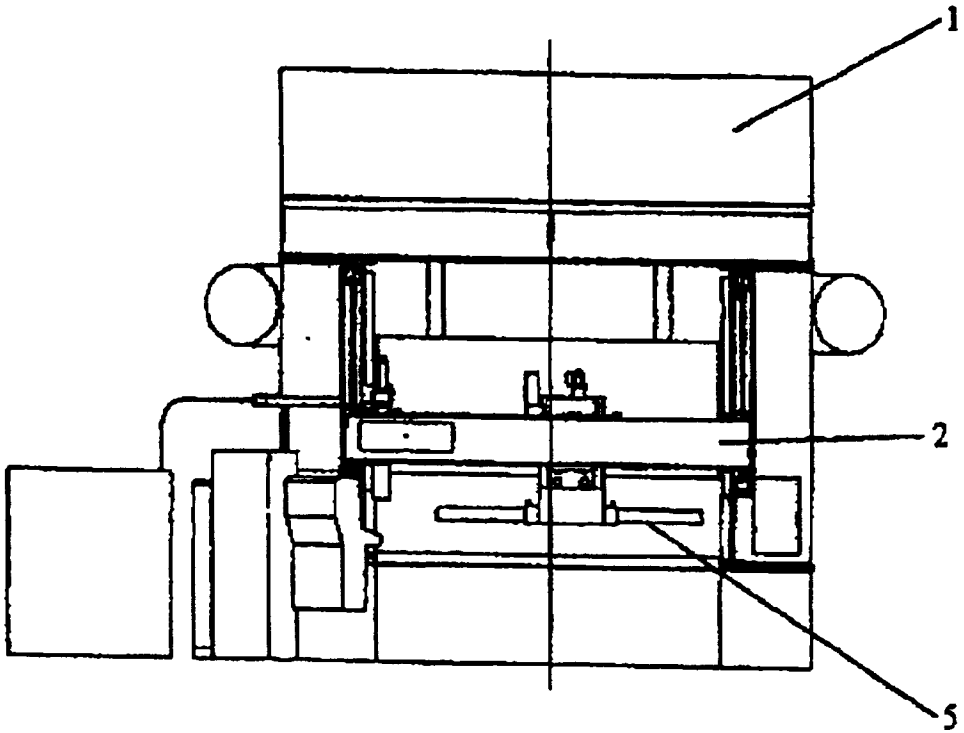
FIG. 2 is a side elevational view of the transfer press shown in FIG. 1.

FIGS. 1 through 3 generally indicate a common or relatively generic multiple-station linear transfer press 1 having attached thereto a press transfer system noted by reference numeral 2. Press 1 includes a press bed 3 that is comprised of a series of spaced apart and aligned work stations 4. Press transfer system 2 includes a transfer rail 5 that in the embodiment shown is positioned generally adjacent to the work stations, having its longitudinal axis generally parallel with the aligned work stations and generally parallel with the direction of movement of workpieces through the press. To impart movement to transfer rail 5, press transfer system 2 utilizes one or more X drive members 6, one or more Y drive members 7, and one or more Z drive members 8. In most modern transfer systems each of the X, Y and Z drive members include individually controllable servo motors that permit maximum flexibility with respect to defining and programming the movement of the transfer rail throughout its operational cycle. Typically each of the X, Y and Z drive members would be controlled by a central micro-processor that is programmed to co-ordinate movement of the workpieces with the cycling of the press. While in the enclosed drawings transfer rail 5 is depicted as being supported upon Y drive member 7, it will be appreciated by those skilled in the art that the transfer rail could equally be supported from the Y drive member and/or the X drive member and/or the Z drive member while not departing from the invention described herein.

Figure 4:
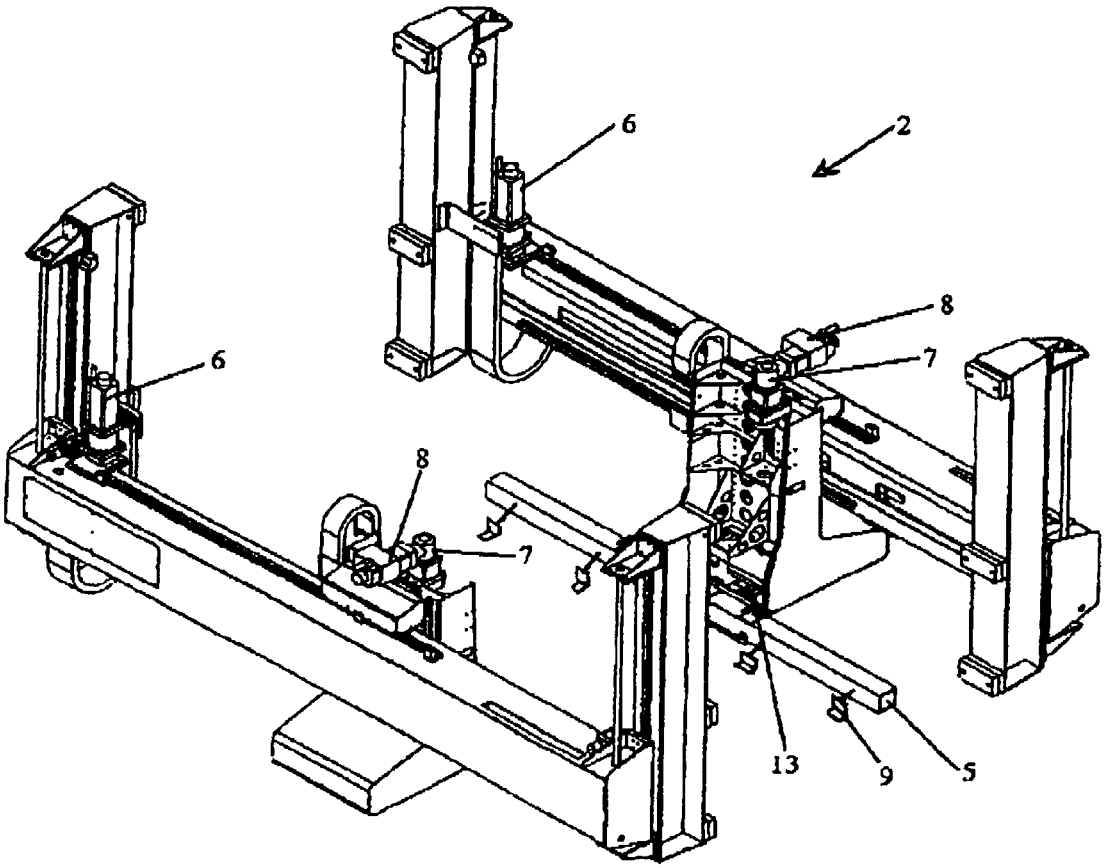
FIG. 4 is an upper side perspective view of the press transfer system of FIG. 1 shown as it would appear if removed from the transfer press.
Figure 5:
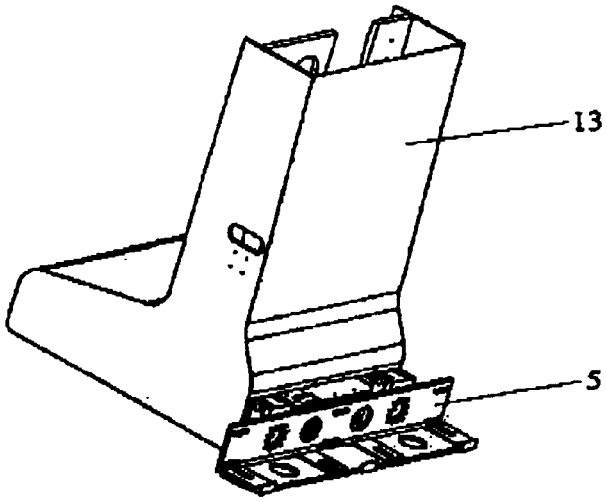
FIG. 5 is an upper side perspective view of the lower portion of a Y-Z axis drive member of a press transfer system that includes a tilt mechanism constructed in accordance with a preferred embodiment of the present invention wherein the tilt mechanism is disengaged.
Figure 6:
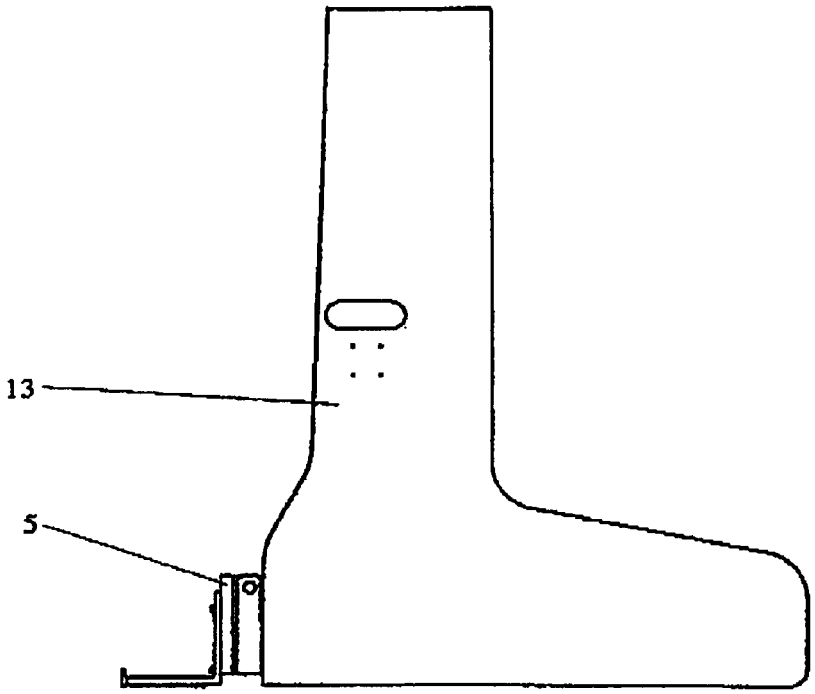
FIG. 6 is a side view of the Y-Z axis drive member and tilt mechanism shown in FIG. 5.
Figure 7:
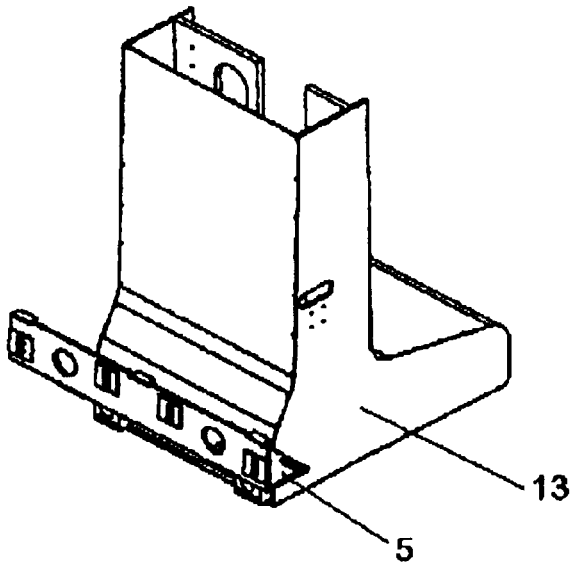
FIG. 7 is an upper side perspective view, opposite to that as shown in FIG. 5, of the Y-Z axis drive member shown in FIG. 3 wherein the tilt mechanism is in its engaged position.
Figure 8:
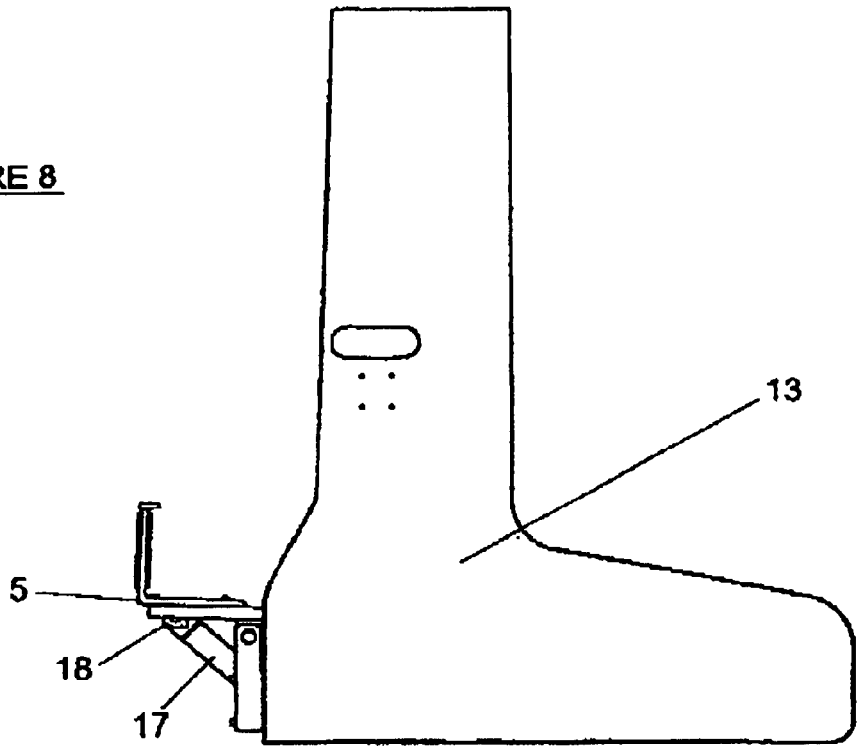
FIG. 8 is a side view of the Y-Z axis drive member shown in FIG. 7.

As indicated in FIG. 4, transfer rail 5 has secured thereto a plurality of fingers or grippers 9 that are used to grasp and lift workpieces from the work stations. Grippers 9 may be secured directly to transfer rail 5 or, alternatively, may be attached to a separate tooling or finger rail that is itself secured to transfer rail 5. Where a tooling or finger rail is utilized changing the grippers requires the removal and replacement of the entire tooling rail, a task that can be often be accomplished more quickly than replacing individual grippers mounted directly upon the transfer rail. However, the length and weight of the tooling rail and the grippers attached thereto may necessitate the use of a number of personnel or lifting equipment to remove and replace the tooling rail.

In accordance with a preferred embodiment of the present invention, there is provided a tilt mechanism 10 that is adapted to impart a tilting or rotational movement to transfer rail 5 about its longitudinal axis. Alternatively, tilt mechanism 10 may provide a means to tilt or rotate a tooling or finger rail that may be mounted to the transfer rail. The tooling rail may either be rotated independently with the transfer rail remaining in a fixed position, or tilt mechanism 10 may rotate the tooling and transfer rails together as a single unit.

Tilt mechanism 10 is comprised generally of at least one connector 11 and at least one actuator 12. In the preferred embodiment that is shown in FIGS. 5 through 10, tilt mechanism 10 includes a pair of connectors which provide a means to secure transfer rail 5 to a modular Y-Z drive member 13. In this embodiment tilt mechanism 10 also includes a single actuator 12. Depending upon the length of the transfer rail, the weight of the grippers and workpieces, and the general configuration and structure of the transfer system it will be understood that other combinations of connectors and actuators could be required. That is, in some cases it may be necessary to utilize a number of connectors and actuators positioned along the length of the transfer and/or tooling rail.

Connectors 11 not only secure the transfer rail (or finger rail as the case may be) to its drive mechanism but also present a mechanical means by which the rail may be pivotally or hingedly secured in place. In FIGS. 5 through 10 connectors 11 are shown as securing the transfer rail directly to Y-Z drive member 13 to effectively support the transfer rail from drive member 13. Connectors 11 are preferably in the form of a hinged structure having first and second legs, 14 and 15 respectively, one of which is connected to drive member 13 with the other connected to transfer rail 5. A pinned or axial connection between first and second legs 14 and 15 permits the transfer rail to be rotated about its longitudinal axis, relative to drive member 13, through a range of approximately 90 degrees.

Rotational movement of the transfer rail is accomplished by means of actuator 12 which is operatively connected to both drive member 13 and to transfer rail 5. The actuator is operable between an engaged and a disengaged position. When press transfer system 2 is in its normal operational mode and ready to assist in the movement of workpieces between work stations in the press bed, actuator 12 is in its disengaged position. At this point the actuator will maintain the transfer rail in an orientation with grippers 9 generally extending toward the work stations and lying in a plane that is generally parallel to the direction of movement of the workpieces through the press. In most instances it is expected that when the actuator is disengaged the outer or front face of the transfer rail will be held in a generally vertical configuration with the grippers supported in a generally horizontal plane.

When desired, actuator 12 may be operated and caused to move from its disengaged to its engaged position. As the actuator engages it causes transfer rail 5 to rotate about is longitudinal axis and to pivot about connectors 11 such that the rail will support grippers 9 in a plane that is generally perpendicular to the direction of movement of workpieces between the work stations. Under most operating conditions such movement will result in the transfer rail rotating approximately 90 degrees to a generally horizontal orientation with the grippers being supported in a generally vertical plane. Tilt mechanism 10 will thus effectively "open up" the press bed causing the grippers to be rotated-out of the way to permit unobstructed access to both the grippers and the work stations.

Figure 9:
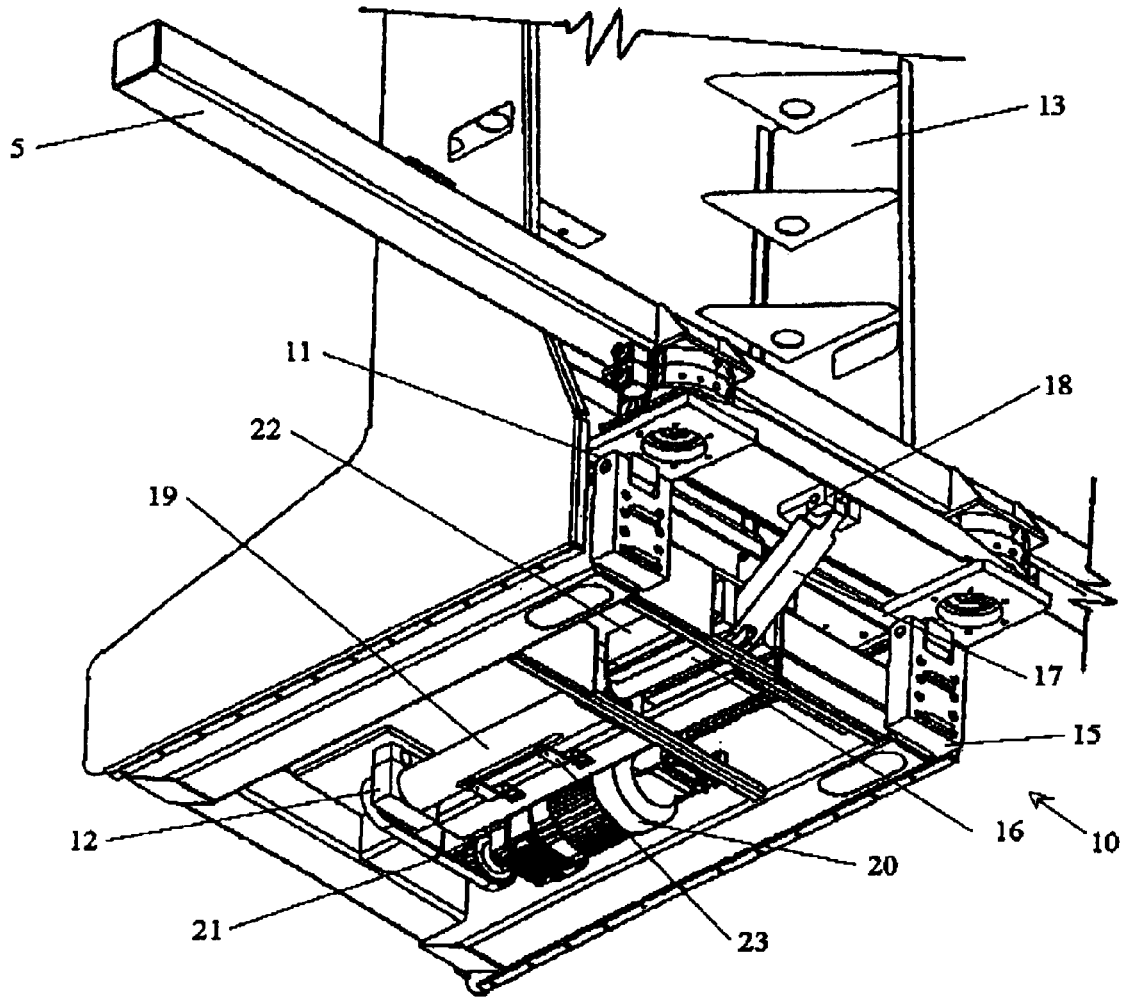
FIG. 9 is a lower front perspective view of the Y-Z axis drive member shown in FIG. 5 having a portion of its shrouding removed to reveal the components of one embodiment of the tilt mechanism of the present invention where the tilt mechanism is in its disengaged position; and, FIG. 10 is a lower front perspective view of the Y-Z axis drive member shown in FIG. 9 with its tilt mechanism in an engaged to standby position.
Figure 10:
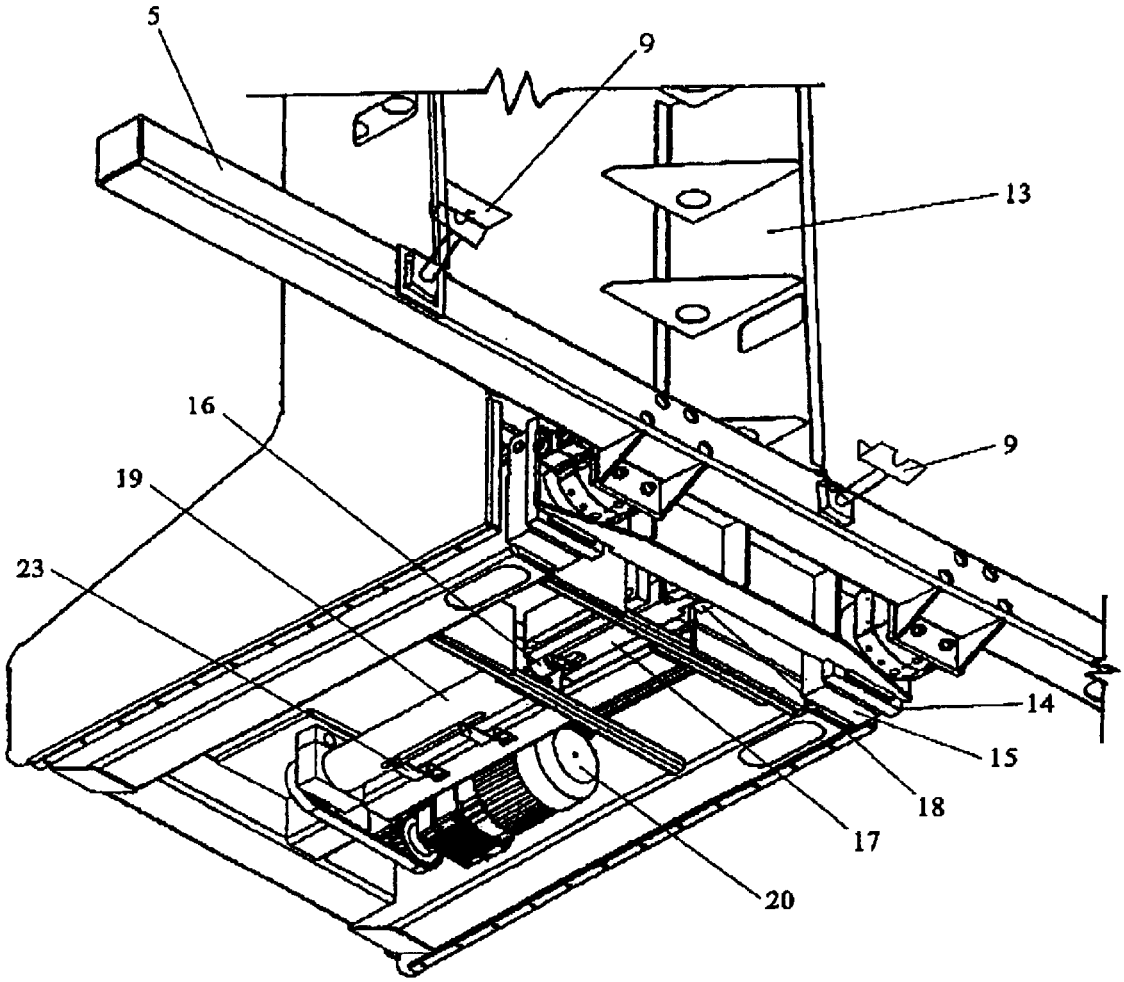

FIGS. 9 and 10 depict a preferred embodiment of actuator 12. In this embodiment the actuator is comprised of a push rod 16 that is connected to a push arm 17, which is in turn pivotally connected to a mounting link 18 secured to transfer rail 5 (or to a tooling rail as the case may be). Push rod 16 is longitudinally advanced or retracted by an actuator body 19. As the push rod is advanced it causes push arm 17 to apply force to mounting link 18 resulting in transfer rail 5 being rotated in an upward direction about its longitudinal axis via the hinged or pivotal movement permitted by connectors 11. Similarly, when push rod 16 is retracted into actuator body 19 push arm 17 will cause mounting link 18 to be drawn toward Y-Z drive member 13 resulting in the transfer rail being rotated in a generally downwardly direction. The range of rotational movement of the transfer rail may be determined by either the physical limits of advancement and retraction of push rod 16 or by mechanical stops that may be incorporated either into the rail itself or within drive member 13. As indicated above, under most circumstances it is expected that the components of actuator 12 will be designed to permit rotational movement of the transfer rail of approximately 90 degrees, from a vertical to a horizontal orientation.

Actuator body 19 may be a hydraulic or pneumatic cylinder, may be a linear induction motor or inductively powered or, as shown in FIGS. 9 and 10, may be a ball screw/ball nut mechanism that is driven by a motor 20. Motor 20 may be connected directly to the actuator body or may transfer movement to the actuator body through the use of a belt or chain drive system 21. As is also indicated in FIGS. 9 and 10, in a preferred embodiment of the invention actuator 12 includes a pair of track members 22 situated on either side of push rod 16 to direct and maintain the path of movement of push arm 17 during the advancement and retraction of push rod 16.

It will be appreciated and understood through an understanding of the above described invention that tilt mechanism 10 presents a mechanism that permits the operator of a press transfer system to quickly and easily rotate the transfer rail (or tooling rail) between generally vertical and horizontal positions. With the rotation of the transfer rail to a horizontal position the grippers or fingers will be rotated in an upward direction and maintained in a generally vertical orientation to allow for easy and unobstructed access to both the press bed and to the grippers themselves. Service and maintenance of the press and the grippers may then be carried out without having to physically remove the grippers (or a tooling rail) from the transfer system. When the necessary service or maintenance is completed the task of re-orientating the grippers is as simple as causing actuator 12 to rotate the transfer rail downwardly into its operational position. The grippers will then once again be oriented in a generally horizontal plane adjacent to the workstations.

Movement of the transfer rail in the above described manner can be accomplished by a single operator through accessing a control system that monitors and activates actuator 12. Tilt mechanism 10 may also include positioning sensors 23 that are connected to the central control system permitting an operator to continuously monitor the position and orientation of the transfer rail and/or tooling rail. Such sensors could monitor the advancement or retraction of push rod 16 and push arm 17, or could monitor the angular orientation of the transfer and/or tooling rails. Through sensing the position of push rod 16 or the angular position of the transfer rail the precise orientation of the grippers will at all times be known. Accordingly, such sensors can be used to control the positioning of the grippers and their movement from an operational to a stand-by configuration.

Further, positioning sensors, in conjunction with actuator 12, allow for the possibility of Afine tuning≈ the orientation of the grippers in situations where the transfer system may not be perfectly in line with the axis of the press. Previously in such cases it has been necessary to use adjustment bolts or spacers in order to change the orientation of a fixed transfer or tooling rail, and hence the position of the grippers vis-a-vis the work stations. The employment of tilt mechanism 10 allows the position of the grippers to be adjusted through operation of actuator 12, causing the angular orientation of the transfer rail and/or tooling rail to be altered where necessary in order to bring the grippers into line with the press bed.

It is to be understood that what has been described are the preferred embodiments of the invention and that it may be possible to make variations to these embodiments while staying within the broad scope of the invention. Some of these variations have been discussed while others will be readily apparent to those skilled in the art. For example, it has been noted that the tilt mechanism may be connected directly to the transfer rail or, alternately, may be connected to a tooling or finger rail to cause the rotation of the tooling rail without imparting rotational movement to the transfer rail itself.

We claim:

1. A tilt mechanism for a transfer rail that is used to support a plurality of grippers for engaging and moving workpieces between a series of spaced apart work stations in a linear transfer press, the transfer rail forming part of a press transfer system of the type having a drive mechanism to impart three dimensional movement to the transfer rail, the tilt mechanism comprising:

(i) at least one connector securing said transfer rail to said drive mechanism and permitting said drive mechanism to impart three dimensional movement to said transfer rail, said connector further permitting said transfer rail to be rotated, relative to said drive mechanism, about an axis parallel thereto; and, (ii) at least one actuator operatively connected to said drive mechanism and to said transfer rail, said actuator operable between an engaged and a disengaged position, when in said disengaged position said actuator causing said transfer rail to support said grippers in an orientation with said grippers generally extending toward said work stations, when moving from said disengaged to said engaged position said actuator causing said transfer rail to rotate about an axis parallel thereto and causing said transfer rail to support said grippers in a plane that is generally perpendicular to the direction of movement of said workpieces between said work stations to facilitate access to said grippers and said work stations.

2. The device as claimed in claim 1 wherein said actuator, when in said disengaged position, maintains said transfer rail in an orientation with said grippers supported in a generally horizontal plane.

3. The device as claimed in claim 2 wherein said actuator, when in said engaged position, maintains said transfer rail in an orientation with said grippers supported in a generally vertical plane.

4. The device as claimed in claim 1 wherein said connector is a hinge having first and second leg members wherein one of said first and second leg members is secured to said transfer rail and the other of said first and second leg members is secured to said drive mechanism.

5. The device as claimed in claim 1 wherein said grippers are supported by a tooling rail, said tooling rail secured to said transfer rail.

6. The device as claimed in claim 1 wherein said actuator is a hydraulic or pneumatic cylinder.

7. The device as claimed in claim 1 wherein said actuator is operated by an electric servo motor.

8. The device as claimed in claim 1 wherein said actuator is a linear induction motor.

9. A tilt mechanism for rail in a press transfer system that is used to support one or more grippers for engaging and moving workpieces between a series of spaced apart work stations in a linear transfer press, the tilt mechanism comprising:

(i) one or more connectors securing said rail to said press transfer system and permitting said press transfer system to impart three dimensional movement to said rail and said one or more grippers supported thereon, said connector also permitting said rail to be rotated, relative to said press transfer system, an axis parallel thereto, said connectors comprising hinges having first and second leg members wherein one of said first and second leg members is secured to said rail and the other of said first and second leg members is secured to said press transfer system; and, (ii) one or more actuators connected to said press transfer system and to said rail, said actuators operable between an engaged and a disengaged position such that movement of said one or more actuators between said engage and said disengage position causes rotation of said rail, relative to said press transfer system, about an axis parallel thereto.

10. The device as claimed in claim 9 wherein said one or more actuators, when in said disengaged position, cause said rail to support said grippers in an orientation such that said grippers generally extend toward said work stations.

11. The device as claimed in claim 10 wherein said one or more actuators, when in said engaged position, cause said rail to support said grippers in a plane that is generally perpendicular to the direction of movement of said workpieces between said work stations to facilitate access to said grippers and said work stations.

12. The device as claimed in claim 11 wherein movement of said one or more actuators between said engaged and said disengaged position causes rotation of said rail through a range of approximately 90 degrees.

13. The device as claimed in claim 9 wherein said rail is a transfer rail.

14. The device as claimed in claim 9 wherein said rail is a tooling or finger rail.

15. The device as claimed in claim 9 wherein said actuator is a hydraulic or pneumatic cylinder, an electric servo motor, or a linear induction motor.

* * * * *

UNITED STATES PATENT AND TRADEMARK OFFICE

CERTIFICATE OF CORRECTION

PATENT NO. : 6,910,362 B2
DATED : June 28, 2005
INVENTOR(S) : Montgomery W. Childs et al.

It is certified that error appears in the above-identified patent and that said Letters Patent is hereby corrected as shown below:

Column 8,
Line 22, change “engage” to -- engaged --.
Line 23, change “disengage” to -- disengaged --.

Signed and Sealed this

Thirtieth Day of August, 2005

JON W. DUDAS
*Director of the United States Patent and Trademark Office*